United States Patent [19]

Moreau

[11] Patent Number: 4,716,857

[45] Date of Patent: Jan. 5, 1988

[54] FURNACE WALL COMPRISING FEED NOZZLES MOLDED IN TWO COMPLEMENTARY PARTS

[75] Inventor: André Moreau, Paris, France

[73] Assignee: Electricite de France, Paris, France

[21] Appl. No.: 885,840

[22] PCT Filed: Dec. 17, 1985

[86] PCT No.: PCT/FR85/00369

§ 371 Date: Jun. 26, 1986

§ 102(e) Date: Jun. 26, 1986

[87] PCT Pub. No.: WO86/03824

PCT Pub. Date: Jul. 3, 1986

[30] Foreign Application Priority Data

Dec. 17, 1984 [FR] France ..... 84 19251

[51] Int. Cl.[4] ..... F22B 37/00

[52] U.S. Cl. ..... 122/6 A; 122/235 B; 110/182.5; 110/338

[58] Field of Search ..... 110/336, 338, 182.5; 122/6 A, 6.5, 6.6, 235 B

[56] References Cited

U.S. PATENT DOCUMENTS

| | | | |
|---|---|---|---|
| 955,387 | 4/1910 | Crosthwaite | 110/336 |
| 1,791,244 | 2/1931 | Nygaard | 110/336 |
| 1,968,934 | 8/1934 | Finn | 110/75 |
| 2,139,004 | 12/1938 | Davey | 122/6 |
| 2,532,990 | 12/1950 | Blaha | 158/1 |
| 3,221,680 | 12/1965 | Reintjes et al. | 110/336 |
| 3,589,318 | 6/1971 | Szatkowski | 122/6.6 |
| 3,828,509 | 8/1974 | Ottmar et al. | 52/497 |

FOREIGN PATENT DOCUMENTS

| | | |
|---|---|---|
| 571636 | 3/1933 | Fed. Rep. of Germany . |
| 2495284 | 6/1932 | France . |
| 749431 | 7/1933 | France . |
| 809562 | 3/1937 | France . |
| 2174509 | 10/1973 | France . |
| 2303254 | 10/1976 | France . |

*Primary Examiner*—Carroll B. Dority, Jr.

*Attorney, Agent, or Firm*—Charles E. Brown; Charles A. Brown

[57] ABSTRACT

A fluid, especially secondary air, feed nozzle of an incinerator furnace, in accordance with the invention, is made in two complementary recessed parts (11, 12). These parts are molded from refractory material (silicon carbide, for example) and assembled by pressing so as to have an outside shape identical to that of the bricks which constitute the wall of the furnace.

8 Claims, 6 Drawing Figures

FURNACE WALL COMPRISING FEED NOZZLES MOLDED IN TWO COMPLEMENTARY PARTS

The present invention concerns a furnace wall, especially of an incinerator, comprising secondary air feed nozzles.

As a general rule the walls of incinerators, especially those for burning urban waste, comprise secondary air feed nozzles.

These walls generally contain a bundle of tubes for heating water circulating within them for subsequent recovery of the thermal energy thus obtained. The nozzles, which pass through the wall, are thus necessarily inserted between neighbouring pipes to feed secondary air into the furnace from feed means.

The walls are generally of refractory materials, specifically in the form of bricks, which are not subject to corrosion. It is known that burning waste produces sulfides (especially CaS, Na2S and FeS) which make the environment inside the furnace especially corrosive.

The secondary air feed nozzles usually project from the inside wall of the furnace. The disadvantage of this is that the projecting part is exposed to the corrosive action of the air laden with sulfides inside the furnace.

This major disadvantage has been overcome in part by surrounding the projecting parts of the nozzles with cement so that only the nozzle opening is exposed. Nevertheless, the inside wall of the nozzle remains in contact with the corrosive air inside the furnace through this opening. Also, ash and waste materials volatilized during combustion tend to collect on the projecting parts. They are rich in sulfides as they have not been completely combusted. This creates two problems which tend to aggravate each other: on the one hand, the sulfides collecting in this way on the projecting parts are even more corrosive than the surrounding environment; on the other hand, they tend to clog the nozzle outlets and so to worsen combustion conditions by reducing the input of secondary air. As is well known, incomplete combustion increases the concentration of sulfides, which are reduced to solid sulfates only on complete combustion. There therefore results a self-perpetuating phenomenon resulting in fouling and corrosion of the furnace, and there may be no remedy for such corrosion.

It is, of course, possible to shut down the furnace periodically in order to clean it and where necessary replace any excessively corroded parts, but this has obvious major disadvantages which are better avoided.

The object of the present invention is to circumvent the disadvantages mentioned hereinabove by proposing, in accordance with the invention, a furnace wall, in particular an incinerator furnace wall, of the kind constructed of elements assembled in the manner of bricks of which certain elements are hollow and constitute nozzles for feeding secondary air into the furnace, said elements being disposed around pipes adapted to convey a cooling fluid, the pipes being disposed in bundles and constituting a metal framework for the wall, characterized in that each nozzle-forming element is in two parts each formed with a longitudinal recess mated together at a substantially horizontal jointing surface and in that the nozzles discharge into the furnace through a generally plane face of the element continuously merging with the corresponding faces of the adjacent elements.

This makes it possible to construct a furnace the walls of which are smooth and offer no opportunity for waste materials, especially sulfides, to accumulate. Moreover, in this way the use of metal, which is subject to corrosion, is avoided through the use of the longitudinal recesses in the two parts which are made of a refractory material, such as silicon carbide, for example.

Also, such nozzles are particularly simple and economical to manufacture, as the refractory material is easily molded.

The characteristics and advantages of the invention will emerge from the following description given by way of example with reference to the appended drawings, in which.

Figure 3:
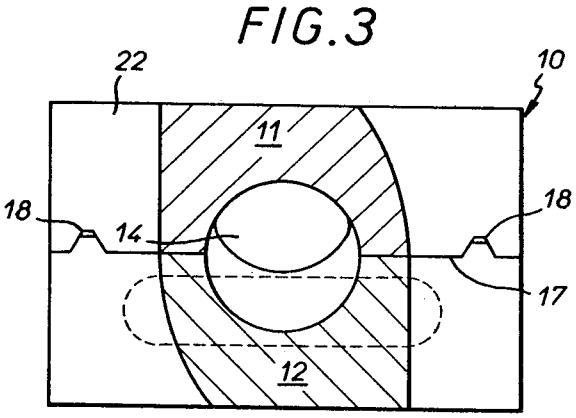
FIG. 3 shows in transverse cross-section an element forming a nozzle in accordance with the invention.

A secondary air feed nozzle of a furnace specifically designed for incineration of waste and constituting one preferred embodiment of the invention is shown in FIGS. 1 through 5.

A nozzle in accordance with the invention comprises two superposed parts, an upper part 11 and a lower part 12. These parts are mated together at a so-called jointing surface 17 extending longitudinally and substantially horizontally, that is to say normally to the lateral surfaces of the element 10 obtained by superposing the upper and lower parts 11 and 12. The two parts 11 and 12 have longitudinal recesses with a shape which, when the two parts are placed together, forms a hollow nozzle within the element 10. The recesses formed in the upper and lower parts 11 and 12 are such that the jointing surface 17 is substantially in the middle of the resulting nozzle.

The element 10 has an anterior part and a posterior part, the anterior part being at the same end as the mouth of the nozzle 13 and the posterior part being at the other end, to which the secondary air feed means are connected. These secondary air feed means, which are known in themselves, do not constitute an integral part of the invention and are not shown in the drawings. On the posterior side of the element 10 the nozzle has a first part 14 of generally cylindrical cross-section formed with two annular grooves 21 running concentrically around it. This part 14 is designed to accommodate a projecting part of the secondary air feed means inserted into the part 14 of the nozzle. The projecting part of the feed means, the part 14 of the nozzle and the annular grooves 21 form connecting means between the nozzle and the secondary air feed means.

After the part 14 the nozzle features a cylindrical intermediate part 15 the diameter of which is less than that of the part 14.

An anterior part of the nozzle 16, generally of flattened beak shape, connects the end of the part 15 to the mouth of the nozzle 13. The upper contour 20 of the part 16 shown in the longitudinal cross-section (FIG. 1) comprises a first segment which extends in a linear manner the upper contour of the cylindrical part 15 and then, substantially in line with the middle of the part 16, curves to define a circular arc which is then extended by a rectilinear end segment as far as the mouth of the nozzle 13. The contour 20 is downwardly inclined, with the result that the longitudinal thickness of the upper part 11 of the element 10 is greater at the level of the mouth 13 than at the level of the junction between the parts 15 and 16.

The lower contour 19 of the anterior part 16 of the nozzle rises and converges from the junction with the part 15 towards the contour 20 as far as the middle longitudinal level of the anterior part 16 where the contour 20 is curved. In this middle area of the anterior part 16 the contour 19 is also curved to define a circular arc which is then extended downwardly by a straight line segment as far as the mouth 13. Nevertheless, the inclination of the rectilinear segment of the contour 19 nearest the mouth 13 is less than that of the corresponding segment of the contour 20. Thus over all of the anterior part 16 of the nozzle and up to the mouth 13 the contours 19 and 20 tend to converge, corresponding to a reduction in the longitudinal cross-section of the nozzle in this part. In the anterior part 16 of the nozzle the contour 19 is substantially symmetrical relative to a line perpendicular to the lower surface of the part 12 of the element 10 and median to the anterior part 16 of the nozzle.

The joint surface 17 extends substantially horizontally and longitudinally in a middle position of the nozzle; it is curved in the anterior part 16 of the nozzle, remaining substantially halfway between two contours 19 and 20.

Figure 4:
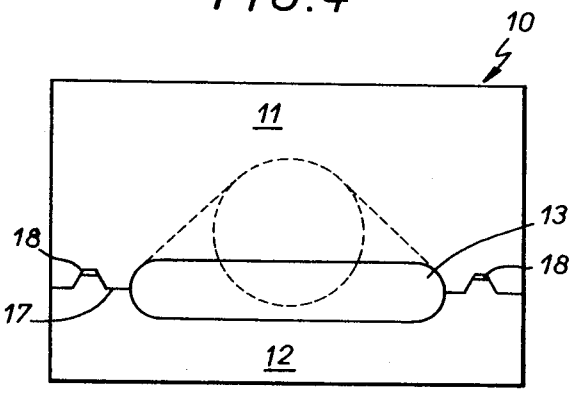
FIG. 4 is a view in elevation of the anterior surface of an element forming a nozzle in accordance with the invention.
Figure 1:
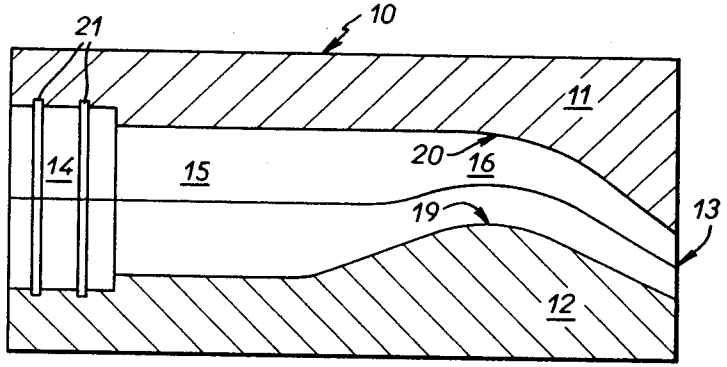
FIG. 1 shows in longitudinal cross-section an element forming a nozzle in accordance with the invention.
Figure 2:
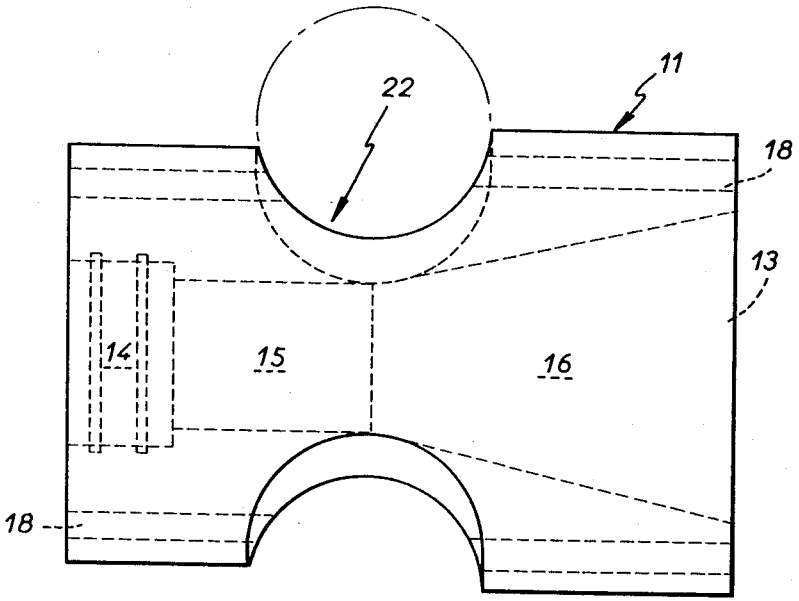
FIG. 2 shows in plan view an element forming a nozzle in accordance with the invention.
Figure 5:
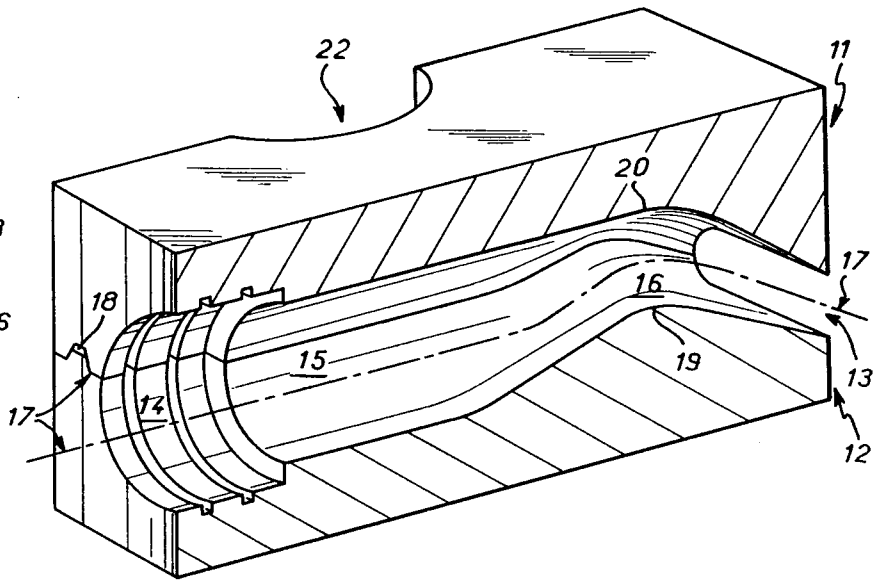
FIG. 5 shows in elevation and in perspective an element forming a nozzle in accordance with the invention cut longitudinally on a vertical plane.

As shown in FIG. 2, the cross-section of the nozzle in the joint surface 17 forms an isosceles trapezium in the anterior part 16. This corresponds to a widening of the nozzle from the junction between the intermediate part 15 and the anterior part 16 up to the mouth 13 of the nozzle. The mouth 13 of the nozzle is an opening coplanar with the anterior surface of the element 10. As shown in FIG. 4, this mouth 13 is generally hippodrome-shaped, having a substantially rectangular shape with semi-circles on the two shorter sides, as shown in FIG. 4. The joint surface 17 which passes through the middle of the mouth 13 has on either side of the mouth two symmetrical cranks 18 the transverse cross-sections of which are generally trapezoidal.

As shown in FIG. 2, the parts 11 and 12 forming the nozzle comprise two lateral recesses 22 the general shape of which is part-cylindrical and which extend symmetrically to each side of the longitudinal axis of the element 10 and normal to the joint surface 17. In this embodiment of the invention the anterior part of the element 10 in front of the lateral recesses is wider than the posterior part to the rear of the lateral recesses 22. As shown in FIGS. 2 and 3, the lateral recesses 22 are flared, one in the upper part 11 and the other in the lower part 12, to form half-funnel shapes respectively towards the top and the bottom of the element 10.

Because of the separation of the two longitudinal cranks 18, they are intersected by the lateral recesses 22. Note that in the embodiment of the invention described, the longitudinal cranks 18 are separated into two parts, an anterior part and a posterior part, by the lateral recesses and are disposed relative to the lateral edges of the element 10 so that each anterior part of a crank 18 is not in alignment with its posterior part.

More precisely, the distance that separates each crank 18 from the nearest lateral edge remains substantially constant over all the length of the element 10.

Figure 6:
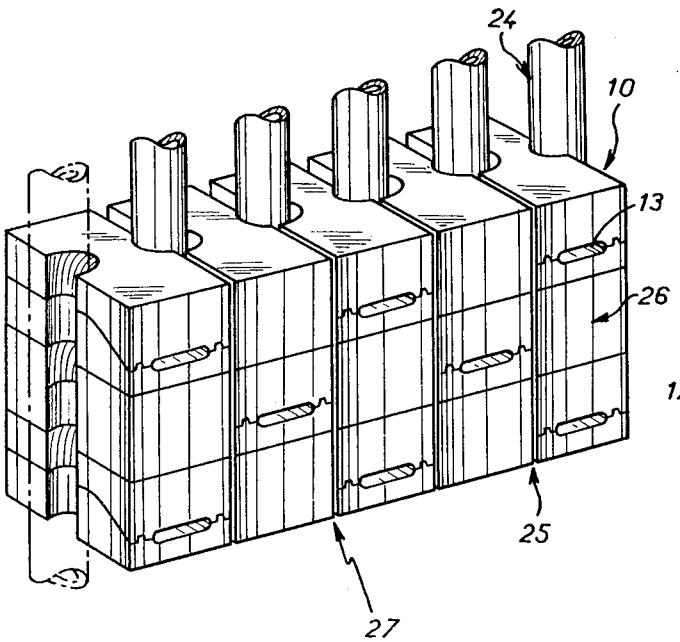
FIG. 6 shows in elevation and in perspective a furnace wall comprising nozzles in accordance with the invention.

As shown in FIG. 6, a furnace wall 17 in accordance with the invention, part of a furnace for incinerating waste, for example, is made up of elements 10 and 26 of refractory material and all of identical overall dimensions. A bundle of cylindrical and parallel pipes 24 passes between these elements in the openings 22 formed therein, such pipes advantageously providing for circulation of water to be heated by contact with the bricks. In practice, thermal interchange simultaneously cools the wall, preventing its temperature rising excessively, and heats the circulating water so that energy is thereby recovered.

The bundle of pipes 24 thus formed is substantially parallel to the anterior surface of the wall 27 of the furnace comprising the combined anterior surfaces of the elements 10 and the elements 26 of identical shape and size. In practice a bundle of pipes of this kind forms a metal framework for the furnace wall.

In practice the pipes 24 are the water tubes of a boiler.

The elements 10 and the elements 26 are stacked up in the manner of bricks, in consecutive adjacent stacks joined together by joints 25. The joints 25 link the anterior lateral surfaces of adjacent elements 10 and 26, these surfaces being in front of the pipes 24. As the posterior width of the elements 26 and 10 behind the bundle of pipes 24 is less than the anterior width, the stacks of elements 10 and 26 are not laterally contiguous over all their depth. This is not of any significant importance, as the anterior parts serve only to hold the elements 26 and 10 in place by preventing any longitudinal displacement of each element relative to the bundle of pipes 24 which thus immobilize it. Note that by distributing a certain number of elements 10 in the furnace wall it is possible to provide the appropriate number of nozzles at the appropriate locations without creating any discontinuity in the surface of the furnace wall. It is thus possible to introduce a small number of elements 10 in place of elements 26, in practice bricks, and to dispose them at the appropriate locations without any disadvantage regarding the construction of the wall 27. The elements 10 and 26 are placed identically by virtue of the half-funnel flared shapes of the lateral recesses 22 in these elements which enable them to be initially disposed slantwise between two adjacent pipes 24 and then fitted into place with a simple tilting movement.

It is advantageous to make the furnace wall of silicon carbide. The use of this material favours thermal interchange between the wall and the bundle of pipes.

It is possible in accordance with the invention to make the nozzles in two parts 11 and 12 as described hereinabove, each of these parts being molded in the same material as the refractory bricks 26, which is silicon carbide in this instance. A nozzle in accordance with the invention is obtained by simply pressing into superposition at the joint surface 17 the lower and upper parts 12 and 11 of an element 10 in accordance with the invention. The longitudinal cranks 18 in the joint surface 17 permit precise juxtaposition of the upper and lower parts 11 and 12 of the element 10. It is possible, in a preferred embodiment of the invention, to provide cranks 18 at the joint surface 17 which are slightly deeper in the part comprising the recessed crank, the upper part in the example shown, than the projecting crank, here in the lower part. This makes it possible to place in the space thus left at the bottom of these cranks a fixing seal, in the form of cement, for example. A fixing seal of this kind makes it possible to fasten the parts 11 and 12 of the element 10 together in a non-removable manner. The element 10 that results is then as if of unitary construction and can be handled as such and form an integral part of the furnace wall, in the same way as a brick 26, whilst still including a secondary air feed nozzle that does not have any projection on the front surface and that does not comprise any metal part. Silicon carbide is chosen as the refractory material in the preferred embodiment of the invention, but those skilled in the art can instead choose any other appropriate refractory material. Likewise, the shape of the nozzle may be adapted to the specific requirements of the embodiment selected by those skilled in the art, and similarly the means for connected the nozzle to the secondary air feed means may be different. It may also be possible to envisage other ways of mounting the elements between adjacent pipes of a bundle of pipes, which are not necessarily vertical. It may also be feasible to make the elements 10 in accordance with the invention in two parts mated together at a vertical longitudinal joint plane, substantially parallel to the lateral walls of the element. The centering cranks on the joint plane may equally well be replaced by other devices, for example male and female locators or any other device chosen by those skilled in the art. Generally speaking, the invention is not limited to the preferred embodiment described but encompasses all variations and improvements that may be made thereto by those skilled in the art.

I claim:

1. A furnace wall, in particular an incinerator furnace wall, of the kind constructed of elements (10, 26) assembled in the manner of bricks some of said elements (10) being hollow nozzle-forming elements for feeding secondary air into the furnace, said elements being disposed around pipes (24) adapted to convey a cooling fluid, the pipes being disposed in bundles and constituting a metal framework for the wall, characterized in that each of said nozzle-forming elements is in two parts (11, 12), each of the parts having a longitudinal recess mating with the other of the parts along a substantially horizontal jointing surface (17), and each of each nozzle-forming elements having a discharge into the furnace through a generally plane face of the element (10) contiguous with the corresponding faces of the adjacent ones of said elements (26).

2. A furnace wall according to claim 1, characterized in that the pipes (24) are disposed in bundles and are entirely embedded within the wall so as to be isolated from the interior of the furnace.

3. A furnace wall according to claim 1, characterized in that the elements (10, 26) constituting the wall are made of silicon carbide.

4. A furnace wall according to claim 1, characterized in that the pipes (24) are the water tubes of a boiler adapted to receive thermal energy through contact with elements (10, 26) of the wall.

5. A furnace wall according to claim 1, characterized in that each of said elements (10, 26) comprises two substantially vertical lateral recesses (22) flared to a substantially half-funnel shape symmetrically relative to the longitudinal axis of the element, so as to enable said elements to be fitted between adjacent pipes (24) by tilting them axially.

6. A furnace wall according to claim 1, characterized in that each nozzle-forming element has at least one arcuate part to prevent any longitudinal displacement of one part of the element relative to the other.

7. A furnace wall according to claim 1, characterized in that the jointing surface (17) of the two parts of each of said nozzle-formingelements (10) includes two longitudinal splines (18) arranged one on each side of the recesses therein, adapted to prevent any lateral translation of one part relative to the other.

8. A furnace wall according to claim 7, characterized in that said longitudinal splines (18) have a trapezoidal cross-section.

* * * * *